US008319180B2

(12) United States Patent
Nikolaev et al.

(10) Patent No.: US 8,319,180 B2
(45) Date of Patent: Nov. 27, 2012

(54) KINGDON MASS SPECTROMETER WITH CYLINDRICAL ELECTRODES

(75) Inventors: Evgenij Nikolaev, Moscow (RU); Jochen Franzen, Bremen (DE)

(73) Assignee: Bruker Daltonik GmbH, Bremen (DE)

( * ) Notice: Subject to any disclaimer, the term of this patent is extended or adjusted under 35 U.S.C. 154(b) by 0 days.

(21) Appl. No.: 13/208,803

(22) Filed: Aug. 12, 2011

(65) Prior Publication Data

US 2012/0043461 A1 Feb. 23, 2012

(30) Foreign Application Priority Data

Aug. 12, 2010 (DE) ..... 10 2010 034 078

(51) Int. Cl.
*H01J 49/28* (2006.01)
*H01J 49/26* (2006.01)
*H01J 49/42* (2006.01)

(52) U.S. Cl. ..... 250/290; 250/281; 250/282; 250/291; 250/292; 250/293

(58) Field of Classification Search ..... 250/281, 250/282, 288, 290–293
See application file for complete search history.

(56) References Cited

U.S. PATENT DOCUMENTS

| | | | | |
|---|---|---|---|---|
| 5,886,346 | A | 3/1999 | Makarov | |
| 7,038,200 | B2 * | 5/2006 | Nikolaev | 250/291 |
| 7,196,326 | B2 * | 3/2007 | Franzen et al. | 250/288 |
| 7,368,711 | B2 * | 5/2008 | Franzen et al. | 250/291 |
| 7,495,211 | B2 * | 2/2009 | Franzen et al. | 250/291 |
| 8,022,358 | B2 * | 9/2011 | Green | 250/282 |
| 2005/0279931 | A1 * | 12/2005 | Franzen et al. | 250/290 |
| 2006/0027743 | A1 * | 2/2006 | Franzen et al. | 250/286 |
| 2006/0226357 | A1 * | 10/2006 | Franzen et al. | 250/307 |
| 2008/0156980 | A1 | 7/2008 | Rather et al. | |
| 2008/0302958 | A1 * | 12/2008 | Green | 250/282 |
| 2009/0014637 | A1 * | 1/2009 | Giles et al. | 250/281 |
| 2009/0078866 | A1 | 3/2009 | Li et al. | |
| 2010/0181475 | A1 | 7/2010 | Makarov et al. | |
| 2010/0258714 | A1 | 10/2010 | Makarov | |
| 2011/0042562 | A1 | 2/2011 | Koster | |
| 2011/0186728 | A1 * | 8/2011 | Franzen et al. | 250/282 |
| 2011/0248159 | A1 * | 10/2011 | Misharin et al. | 250/283 |
| 2012/0112056 | A1 * | 5/2012 | Brucker et al. | 250/282 |

FOREIGN PATENT DOCUMENTS

| | | |
|---|---|---|
| DE | 102009050039 | 4/2011 |
| WO | 2011045144 | 4/2011 |

* cited by examiner

*Primary Examiner* — Bernard E Souw
(74) *Attorney, Agent, or Firm* — O'Shea Getz P.C.

(57) ABSTRACT

The invention relates to measuring devices of an electrostatic Fourier transform mass spectrometer and measurement methods for the acquisition of mass spectra with high mass resolution. The measuring device includes electrostatic measuring cells according to the Kingdon principle, in which ions can, when appropriate voltages are applied, orbit on circular trajectories around the cylinder axis between two concentric cylindrical surfaces, which are composed of specially shaped sheath electrodes, insulated from each other by parabolic gaps, and can harmonically oscillate in the axial direction, independently of their orbiting motion. In the longitudinal direction, the two cylindrical surfaces of the measuring cell are divided by the parabolic separating gaps into different types of double-angled and tetragonal sheath electrode segments. Appropriate voltages at the sheath electrode segments generate a potential distribution between the two concentric cylindrical surfaces which forms a parabolic potential well in the axial direction for orbiting ions. The ion clouds oscillating harmonically in the axial direction in this potential well induce image currents in suitable electrodes, from which the oscillation frequencies can be determined by Fourier analyses.

15 Claims, 7 Drawing Sheets

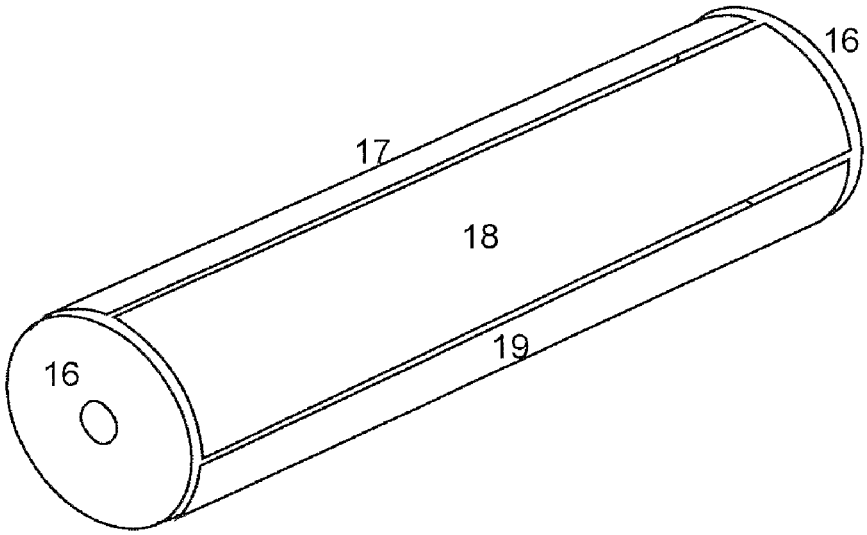
FIG. 1 – PRIOR ART
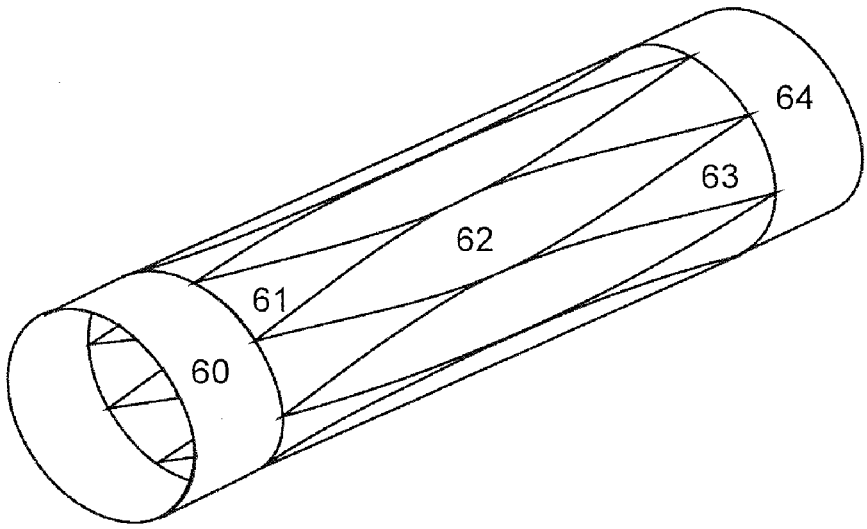
FIG. 2 – PRIOR ART

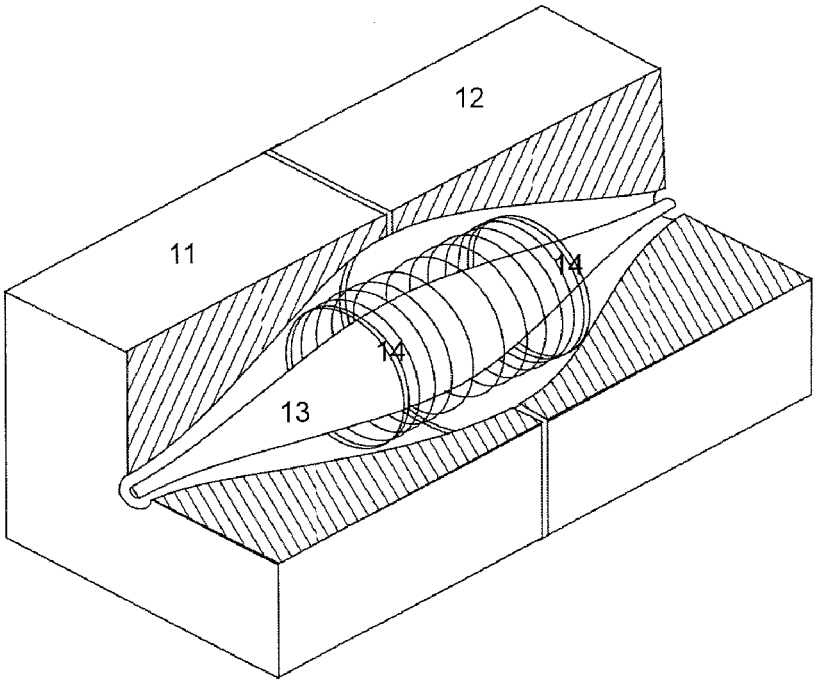
FIG. 3 – PRIOR ART
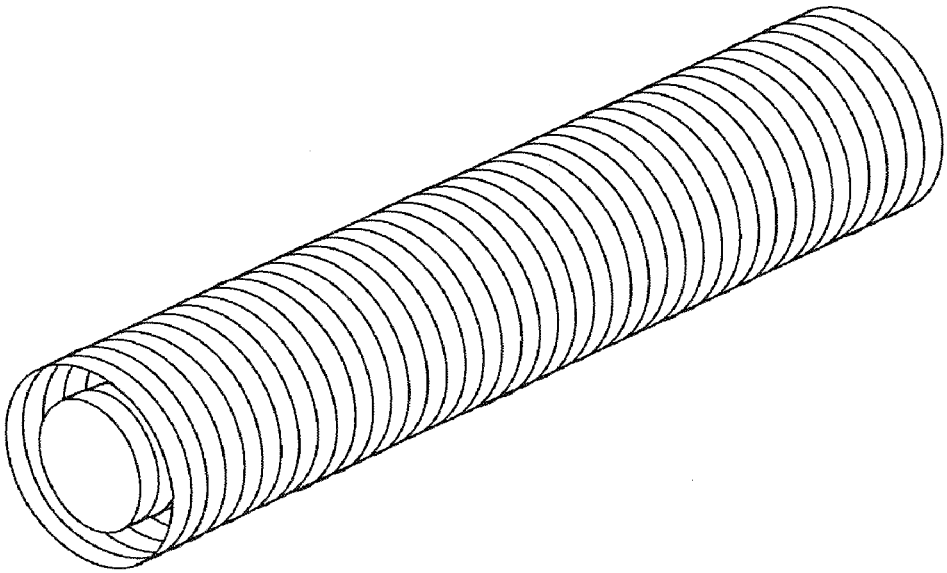
FIG. 4 – PRIOR ART

KINGDON MASS SPECTROMETER WITH CYLINDRICAL ELECTRODES

PRIORITY INFORMATION

This patent application claims priority from German Patent Application 10 2010 034 078.2 filed on Aug. 12, 2010, which is hereby incorporated by reference.

FIELD OF THE INVENTION

The invention relates generally to the field of mass spectrometers, and in particular to measuring devices of an electrostatic Fourier transform mass spectrometer and measurement methods for the acquisition of mass spectra with high mass resolution.

BACKGROUND OF THE INVENTION

Precise mass determination is important in modern mass spectrometry, particularly in biological mass spectrometry. No limit for the mass accuracy is known beyond which no further increase in the useful information content may be expected. Increasing the mass accuracy is therefore a goal which will continue to be pursued. A high mass accuracy alone is often not sufficient to solve a given analytical task, however. In addition to high mass accuracy, a high mass resolving power is particularly important because in biological mass spectrometry, in particular, ion signals with slight mass differences must frequently be detected and measured separately. In enzymatic digestion of protein mixtures, for example, there are thousands of ions in a mass spectrum; five to ten or more different ionic species of the same nominal mass number must often be separated and precisely measured. Crude oil mixtures even contain hundreds of ionic species with the same nominal mass number. The highest mass resolutions are nowadays achieved with Fourier transform mass spectrometers.

"Fourier transform mass spectrometers" (FT-MS) is the term used for all types of mass spectrometer in which ions of the same mass flying coherently in clouds that are oscillating, orbiting on circular trajectories or otherwise periodically moving, generate image currents in detection electrodes. These currents are stored as "transients" after being amplified and digitized; the frequencies of the periodic motions can be derived from these transients by Fourier analysis. The Fourier analysis transforms the sequence of the original image current measurements of the transient from a "time domain" into a sequence of frequency values in a "frequency domain". The frequency signals of the different ionic species, which can be recognized as peaks in the frequency domain, can then be used to determine the mass-to charge ratios m/z and their intensities very precisely. There are several types of such Fourier transform mass spectrometer that will be briefly explained here.

In ion cyclotron resonance mass spectrometers (FT-ICR-MS), the mass-to-charge ratios m/z of the ions are measured by the frequencies of the orbital motions of clouds of coherently flying ions in strong magnetic fields. This is done in ICR measuring cells that are in a homogeneous magnetic field of high field strength. The ions, which are first introduced on the axis of the measuring cell and trapped there, are brought to the desired orbits by excitation of their cyclotron motions. The orbital motion normally includes superpositions of cyclotron and magnetron motions, with the magnetron motions slightly distorting the measurement of the cyclotron frequencies. The magnetic field is generated by superconducting magnet coils cooled with liquid helium. Nowadays, commercial mass spectrometers provide usable ICR measuring cell diameters of up to approximately 6 centimeters at magnetic field strengths of 7 to 18 tesla. Higher field strengths offer advantages, in that some of the quality factors for the mass spectrometers depend linearly on the field strength, and others even on the square of the field strength.

In the ICR measuring cells, the orbital frequency of the ions is measured in the most homogeneous part of the magnetic field. Measuring cells in the form of a cylindrical sheath are usually used. Such an ICR measuring cell is shown in FIG. 1. The ICR measuring cells usually comprise four longitudinal electrodes, e.g., 17, 18, 19, which extend parallel to the magnetic field lines and surround the inside of the measuring cell like a sheath. To prevent the ions escaping, trapping plates 16, whose potential keeps the ions in the cell, are mounted at the ends of the measuring cell. Two opposing longitudinal electrodes, 17 and 19 for example, are used to bring the ions introduced close to the axis through the trapping plates 16 to larger orbits of their cyclotron motion. Ions with the same mass-to-charge ratio m/z are excited as coherently as possible in order to obtain a cloud of ions orbiting in phase. The other two electrodes, of which only one 18 is visible here, serve to measure the orbiting of the ion clouds by their image currents, which are induced in the electrodes as the ion clouds fly past. Introducing the ions into the measuring cell, ion excitation and ion detection are carried out in successive phases of the method, as is known to anyone skilled in the art.

Since the mass-to-charge ratio of the ions is unknown before the measurement, they are excited by the longitudinal electrodes 17, 19, using a mixture of excitation frequencies which is as homogeneous as possible. This mixture can be a temporal mixture with frequencies increasing with time (this is then called a "chirp"), or it can be a synchronous computer-calculated mixture of all frequencies (a "sync pulse"); chirps are usually used.

The FT-ICR mass spectrometers are currently the most accurate of all types of mass spectrometer. The accuracy of the mass determination ultimately depends on the number of ion orbits that can be detected by the measurement, i.e., on the usable duration of the transient. Conventional measuring cells with four longitudinal electrodes and trapping electrodes at the ends provide image current transients with durations of up to a few seconds (usually up to around five seconds), which result in a resolution of around R=100,000 for ions of the mass-to-charge ratio m/z=1000 u (atomic mass units).

German Patent DE 10 2009 050 039.1 to I. V. Boldin and E. Nikolaev discloses an ICR measuring cell illustrated in FIG. 2 which establishes a new generation of high-performance ICR mass spectrometers. The measuring cell represents the latest state of the art for the ICR measuring technology; it has a cylindrical sheath which is divided by parabolic separating gaps into crown, diamond and lancet-shaped sheath electrodes segments 60 to 64. The measuring cell surprisingly provides resolutions far in excess of one million for ions of mass m/z=1000 u, even in moderately strong magnetic fields of only seven tesla when complex mixtures are present, and far in excess of ten million for isolated ionic species. As simulations in supercomputers have shown, the measuring cell has coherence-focusing characteristics: the clouds of the individual ionic species are each held close together, so transients with a duration of several minutes can be measured. There is still no simple, intuitive explanation for the mechanism of coherence focusing, but it can be assumed that it is connected with the many slight potential jumps which the ions experience on their trajectory.

Although ICR mass spectrometers are quite outstanding, they still have the disadvantage that they must be operated with superconducting magnets. They are therefore expensive, heavy and unwieldy to handle. For a number of years now, electrostatic Fourier transform mass spectrometers have been successfully marketed in competition with ICR mass spectrometers; they provide a similarly high resolution but are much smaller.

This second type of Fourier transform mass spectrometer is based on Kingdon ion traps. Kingdon ion traps are generally electrostatic ion traps in which ions can orbit one or more inner electrodes or oscillate through between several inner electrodes, without there being any magnetic field. An outer, enclosing housing is at a DC potential which the ions with a set kinetic energy cannot reach. In special Kingdon ion traps suitable as measuring cells for mass spectrometers, the interior surfaces of the housing electrodes and the outer surfaces of the inner electrodes are designed so that, firstly, the motions of the ions in the longitudinal direction of the Kingdon ion trap are completely decoupled from their motions in the transverse direction and, secondly, a parabolic potential well is generated in the longitudinal direction in which the ions can oscillate harmonically. Here, the term "Kingdon ion trap", and especially the term "Kingdon measuring cell", refers only to these special forms in which ions can oscillate harmonically in the longitudinal direction, completely decoupled from their motions in the transverse direction.

If clouds of coherently flying ions move longitudinally in the parabolic potential profile, the ion clouds with different charge-related masses each oscillate with their own, mass-dependent frequencies. The frequencies are inversely proportional to the square root $\sqrt{(m/z)}$ of the charge-related mass m/z. The two electrodes of a housing with a central, transverse split, for example, are suitable as detection electrodes for image current measurements. The oscillating ions induce image currents that can be stored as transients. A Fourier analysis can be used to obtain a frequency spectrum from these transients, as has already been described above, and the mass spectrum can then be obtained from this by conversion.

U.S. Pat. No. 5,886,346 to A. A. Makarov discusses the fundamentals of a special Kingdon ion trap which was launched by Thermo-Fischer Scientific GmbH Bremen under the name Orbitrap®. FIG. 3 represents such an electrostatic ion trap. The decoupling of the motions in the transverse and axial direction is achieved solely by the special shape of the electrodes. The Orbitrap® trap consists of a single spindle-shaped inner electrode 13 and coaxial housing electrodes 11, 12 transversely split down the center. The housing electrodes have an ion-repelling electric potential, and the inner electrode an ion-attracting electric potential. With the aid of an ion lens, the ions are tangentially injected as ion packets through an opening in the housing electrode, and they circulate on orbital and axial trajectories 14 in a hyper-logarithmic electric potential. The kinetic injection energy of the ions is adjusted so that the attractive forces and the centrifugal forces of the orbital motion cancel each other out, and the ions therefore largely move on virtually circular trajectories. The maximum useful duration of the image current transients of an Orbitrap® trap is (similar to conventional ICR mass spectrometers) in the order of around five seconds. The mass resolution is currently around R=100,000 at m/z=1,000 atomic mass units; with good instruments it can be higher.

German Patent DE 10 2007 024 858 A1 to C. Köster discloses additional types of Kingdon ion traps which have several inner electrodes. These Kingdon measuring cells can be produced with the same decoupling of the ions' radial and axial motion. The ions can oscillate in a plane between two inner electrodes, for example, which produces a particularly simple way of introducing the ions into a Kingdon measuring cell.

An advantage of Kingdon ion trap mass spectrometers compared to ion cyclotron resonance mass spectrometers (ICR-MS) with similarly high mass resolutions R is that no magnet is required for storing the ions, and so the technical set-up is much less complex. Even bench-top instruments are conceivable. The ions are stored here either oscillating or orbiting in a DC field, and thus require only DC voltages at the electrodes, but these DC voltages must be kept constant with a very high degree of precision. Moreover, the decrease in resolution R towards higher ion masses in Kingdon ion trap mass spectrometers is only inversely proportional to the square root $\sqrt{(m/z)}$ of the mass-to-charge ratio m/z of the ions, whereas in ICR-MS the decrease in resolution R is inversely proportional to the charge-related mass m/z itself; this means the resolution falls off much more rapidly toward higher masses in ICR-MS in an unfavorable way.

It is not yet known why the useful duration of the image current transient in Kingdon measuring cells is limited to an order of magnitude of around five seconds. Very good ultra-high vacua, of better than $10^{-7}$ pascal if possible, must be generated in Kingdon measuring cells (as is the case in ICR measuring cells) in order for collisions not to force the ions from their trajectory. The mean free path of the ions must amount to hundreds of kilometers. The limitation of the image current transient may therefore be attributable to a residual pressure in the almost closed measuring cells, which are very difficult to evacuate. On the other hand, it is possible that slight flaws in the shape of the inner and outer electrodes, which have to be manufactured with highest precision, limit the useful duration of the image current transient. Deviations in shape can generate a tiny residual coupling of the axial and transverse ion motions, especially in conjunction with angular and energy variations of the ion injection. Even a very weak residual coupling may have devastating effects on the ion trajectories after the ions have orbited a few ten thousand times. As is known from coupled oscillation systems, there are necessarily transitions of the energy from one direction of oscillation to the other, which means, for example, that the axial oscillation amplitude can increase so much that the ions impact on the outer electrodes and are thus destroyed. The Kingdon measuring cells described here decouple the axial and transverse ion motions solely by their shape; there is no mechanical or electrical correction when the device is in operation. Particularly, there is no attempt at a coherence focusing of any kind which may counteract a residual coupling.

The hyperlogarithmic electric field also can be generated by completely other forms of cells. A very simple possibility includes dividing the surfaces of both an inner and an outer cylinder, as is shown in FIG. 4, into electrode rings, which are insulated from each other, and applying potentials, which increase parabolically from the center outward to the ends so that in the space between the cylindrical surfaces an essentially parabolic potential well is created along the axis for the ions introduced. This requires at least five, but preferably a much larger number of ring electrodes per cylindrical sheath. An identical voltage difference is applied between corresponding rings of the inner and the outer cylindrical sheath so that a radial field which is practically constant over the length is generated between the cylindrical sheaths, and ions with appropriate kinetic energy can orbit around the inner cylinder in this radial field. Such cylindrical Kingdon ion traps are described in published PCT Application WO 2007/000587 to A. A. Makarov and U.S. Published Patent Application 2009/0078866 A1 to G. Li and A. Mordehai.

When the term "acquisition of a mass spectrum" or a similar phrase is used below in connection with Fourier transform mass spectrometers, this includes the entire sequence of steps from the filling of the measuring cell with ions, excitation of the ions to cyclotron orbits or oscillations, measurement of the image current transients, digitization, Fourier transform, determination of the frequencies of the individual ionic species and, finally, calculation of the mass-to-charge ratios and intensities of the ionic species which represent the mass spectrum.

In view of the above there is a need of providing a measuring device with an electrostatic measuring cell for measuring ion oscillations in potential wells; this measuring cell, in particular, being easier and more efficient to evacuate than current electrostatic measuring cells, allowing field corrections for the decoupling of the axial and transverse motions of the ions when the device is in operation, and even providing coherence focusing if possible.

SUMMARY OF THE INVENTION

According to an aspect of the present invention, a measuring device with electrostatic measuring cells according to the Kingdon principle is provided, in which ions can, when appropriate voltages are applied, orbit on circular trajectories around the cylinder axis between two concentric cylindrical surfaces, which are composed of specially shaped sheath electrodes, insulated from each other, and can harmonically oscillate in the axial direction, independently of their orbiting motion. In the longitudinal direction, the two cylindrical surfaces of the measuring cell are divided by parabolic separating gaps into different types of double-angled and tetragonal sheath electrode segments. Appropriate voltages at the sheath electrode segments generate a potential distribution between the two concentric cylindrical surfaces which forms a parabolic potential well in the axial direction for orbiting ions. The ion clouds oscillating harmonically in the axial direction in this potential well induce image currents in suitable electrodes, from which the oscillation frequencies can be determined by Fourier analyses.

A measuring device with an electrostatic measuring cell according to the Kingdon principle comprises sheath electrodes shaped by parabolic gaps, insulated from each other, which form two concentric cylindrical surfaces. When appropriate voltages are applied to the sheath electrode segments, ions injected tangentially into the space between the two cylindrical surfaces may orbit on circular trajectories around the inner cylinder and can harmonically oscillate in the axial direction, independently of their orbiting motion.

These measuring cells may be completely open at the ends of the cylinders and can therefore be evacuated efficiently. The voltages at the sheath electrode segments of the device illustrated in FIG. 5 may be finely adjusted, and therefore corrections of the decoupling between transverse and axial motion are possible even when the device is in operation; the duration of the image current transient can be thus optimized.

The sheath electrode segments of the two concentric cylindrical surfaces may be generated by parabolic separating gaps. They may include different crown-like, tetragonal and double-angled shapes with curved edges. In FIG. 14, only the crown-like 71, 73 and the double-angled 72 forms are present. The ions may be injected tangentially into the space between the cylinders through an appropriate sheath electrode segment, outside the center plane. Appropriate voltages at the sheath electrode segments may generate a potential distribution between the two concentric cylinders which forms a parabolic potential well in the axial direction for orbiting ions in the average over space and time. The ions must fly through a number of slight potential jumps on their orbits. It is highly probable that the slight potential jumps which the ions experience on their trajectories lead to coherence focusing, as is the case in similarly formed ICR cells.

The ion clouds oscillating harmonically in the axial direction in the potential well induce image currents in suitable electrodes, from which Fourier analyses can determine the oscillation frequencies and thus the mass-to-charge ratios m/z of the ions.

These and other objects, features and advantages of the present invention will become more apparent in light of the following detailed description of preferred embodiments thereof, as illustrated in the accompanying Figures.

BRIEF DESCRIPTION OF THE DRAWING

FIG. 1 illustrates a prior art ICR measuring cell of the cylindrical type with two trapping plates 16 and four longitudinal electrodes (one not shown);

FIG. 2 illustrates an ICR measuring cell that is divided by parabolic separating gaps into annular, triangular and double-angled sheath electrode segments 60 to 64. This measuring cell maintains the coherence of the individual clouds of ions of the same mass and provides useful image current transients of several minutes' duration.

FIG. 3 illustrates a prior art electrostatic Kingdon ion trap of the "Orbitrap®" type with a housing electrode which is centrally divided in the transverse direction into two halve electrodes 11, 12 and a spindle-shaped inner electrode 13 in a three-dimensional representation. In the Kingdon ion trap, the ions orbit around the inner electrode 13 and execute harmonic oscillations in the longitudinal direction. The motions 14 of the ions take place in the surface of a cylinder; they are shown only schematically here. The image currents thus induced in the electrodes 11, 12 are measured and subjected to a Fourier analysis, which gives the frequencies of the ionic species involved.

FIG. 4 illustrates the principle of another Kingdon measuring cell according to prior art, described in International Application WO 2007/000587 and U.S. Published Patent Application 2009/0078866 A1. The cell comprises a large number of ring electrodes, insulated from each other, which form two concentric cylindrical sheaths. Both cylindrical sheaths are similarly split in the longitudinal direction to form ring electrodes; each cylindrical sheath should comprise at least six, preferably very many more ring electrodes. Identical voltage differences between corresponding ring electrodes of the outer and inner cylindrical sheaths generate a constant radial field over the length of the measuring cell, in which the ions can orbit around the inner cylinder. Potentials at the ring electrodes, which increase from the center outwards, can generate an axial potential well in the space between the two cylindrical sheaths, in which the orbiting ions can oscillate harmonically in the axial direction. Apart from residual ripples, the electric field corresponds to the hyper-logarithmic field of the Kingdon measuring cell according to FIG. 3. But here the axial and orbital motions of the ions can be completely decoupled from each other by fine adjustment of the potential.

Figure 5:
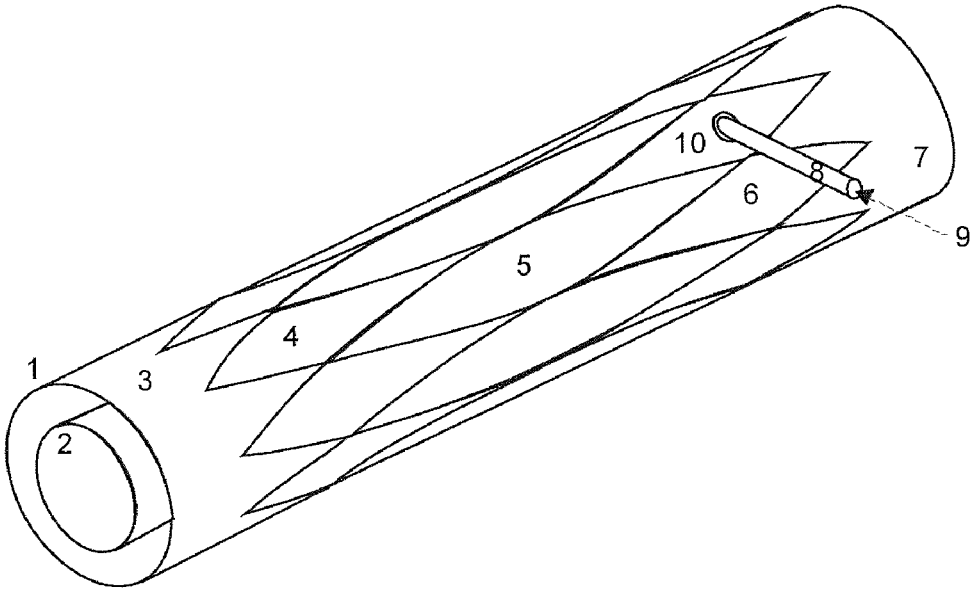
FIG. 5 illustrates an electrostatic Kingdon ion trap according to an aspect of the present invention. Groups of eight sheath electrode segments of the types (e.g., 4, 5 and 6), terminated at both ends by a crown-shaped sheath electrode segment 3, 7, form one of the cylindrical sheaths 1 or 2. The two cylindrical sheaths are concentrically nested in each other. The same voltage ΔV is applied everywhere at corresponding sheath electrode segments of the outer and inner cylindrical sheaths so that the same radial field exists everywhere in a good approximation in the space between the two cylinders, and ions with the correct energy can orbit around the inner cylinder in this radial field. If a potential U is applied to the group of the central, double-angled sheath electrode segments of type 5, a potential (U+ΔU) to the sheath electrode segments of types 4 and 6, and a potential (U+2ΔU) to the two crown-shaped end electrodes, orbiting ions experience, in the temporal average, an axial potential profile in the form of a parabolic potential well, in which they can oscillate harmonically in the axial direction. The electric field here is not hyper-logarithmic, but rather more complicated. The ions 9 are injected through the sheath electrode 10 via the injection tube 8 into a tangential orbit.
Figure 7:
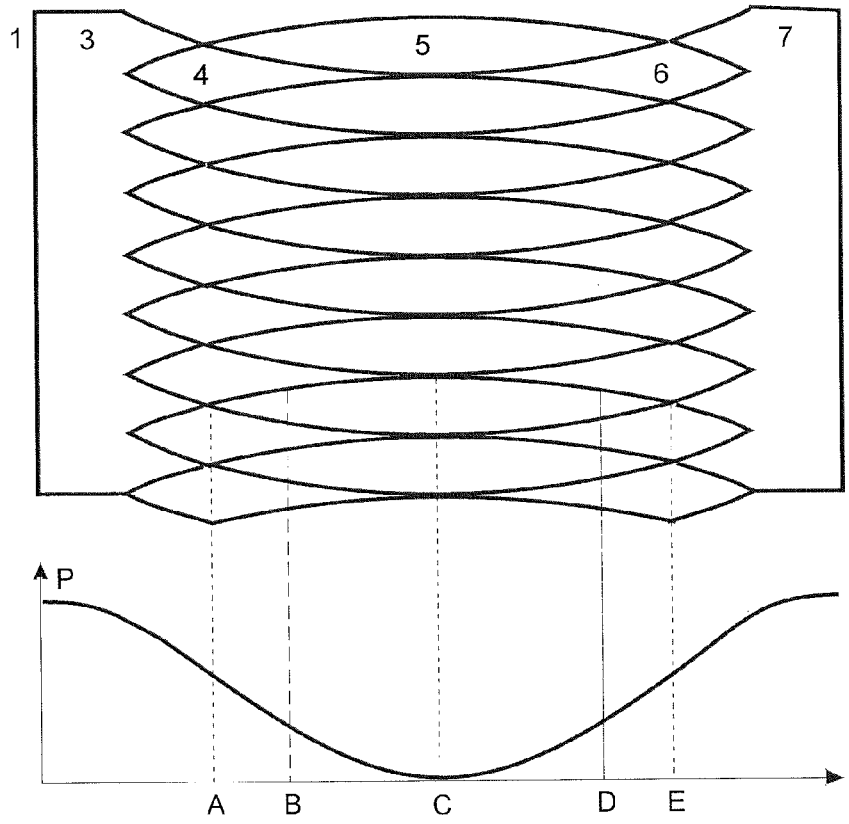

The top part of FIG. 7 depicts the groups of sheath electrode segments of types 3-7 of the outer cylinder from FIG. 5 in unrolled (developed) form in a plane. The sheath electrode segments are created by parabolic separating gaps, which do not reach to the end here, so crown-shaped end electrode segments are produced. The sheath electrode segments of the inner cylindrical sheath are generated by a geometrically similar division. The bottom diagram shows the potential profile P which forms in the center between inner and outer cylindrical sheaths in the longitudinal direction for an orbiting ion, when averaged over time, and forms a potential well. In the region between (A) and (E) the potential well has a very good parabolic form.

Figure 8:
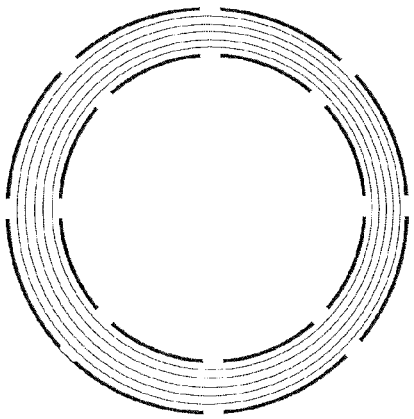

FIG. 8 depicts the radial potential distribution in the cross-sections (A), (C) and (E) of FIG. 7. The ions fly here through eight pairs of sheath electrode segments, which each belong to one group; the radial field strength is precisely the same everywhere and has no tangential components.

Figure 9:
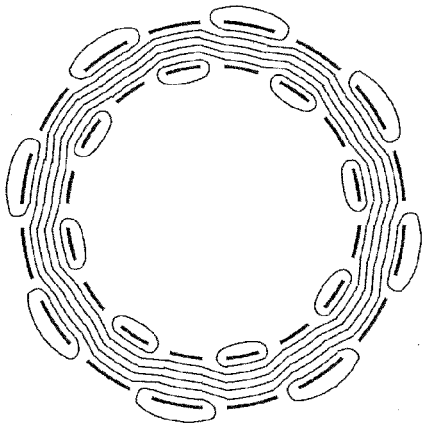

FIG. 9 illustrates the slightly modified radial potential distribution in the cross-sections (B) and (D) of FIG. 7. In this embodiment, the ions fly here through 16 pairs of sheath electrode segments, which belong to two different groups with different potentials, and at every transition they experience a slight change of potential, which reverses again at the next transition. Although the radial field strength is precisely the same everywhere between the sheath electrode segments, there are transitional regions with tangential field components between adjacent sheath electrode segments of different groups. The ions can also orbit around the inner electrode in this potential distribution, but the orbits are no longer completely circular.

Figure 10:
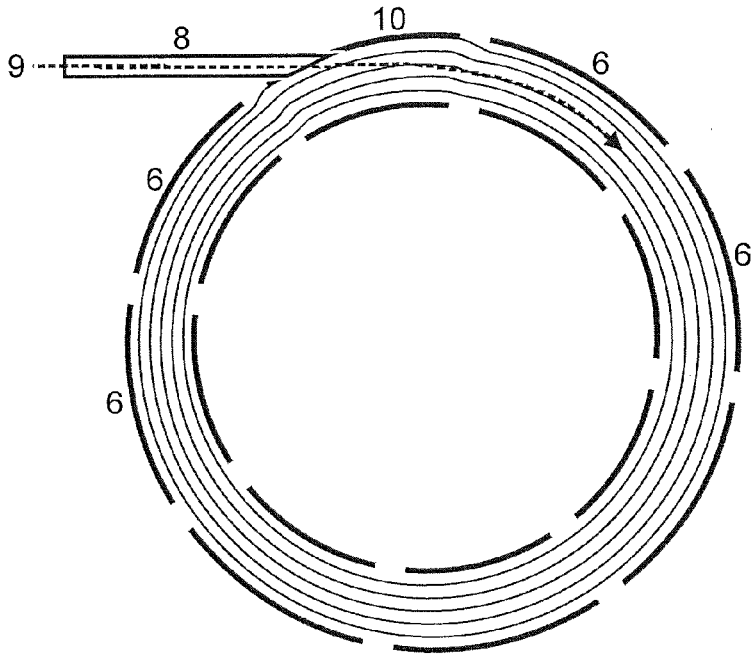

FIG. 10 illustrates the tangential injection of the ions 9 through the tube 8 and the sheath electrode segment 10. A modified potential at the sheath electrode segment 10 or only at the tube 8, which is installed so as to be insulated, or at both causes the radial field here to be weakened to such an extent that the ions arrive at the desired orbit on a trajectory with a slightly larger radius after leaving the tube.

Figure 11:
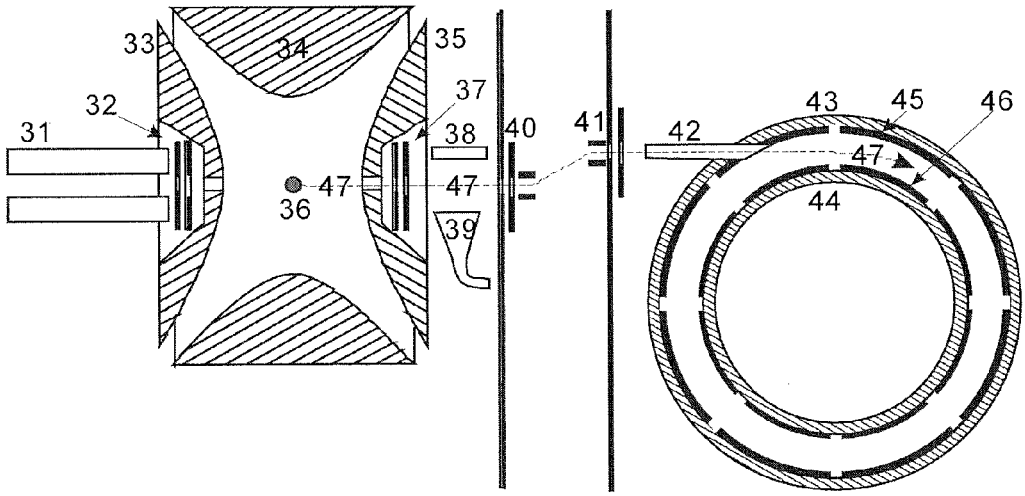

FIG. 11 illustrates a combination of a three-dimensional Paul RF ion trap and a Kingdon ion trap according to an aspect of the invention. The ions of the ion cloud 36 from the Paul trap with end cap electrodes 33, 35 and ring electrode 34 can be ejected from the Paul trap, and injected along the ion trajectory 47 with the acceleration and deflection elements 37, 40 and 41, through the injection tube 42 and into the Kingdon trap with the electrodes 45, 46.

Figure 12:
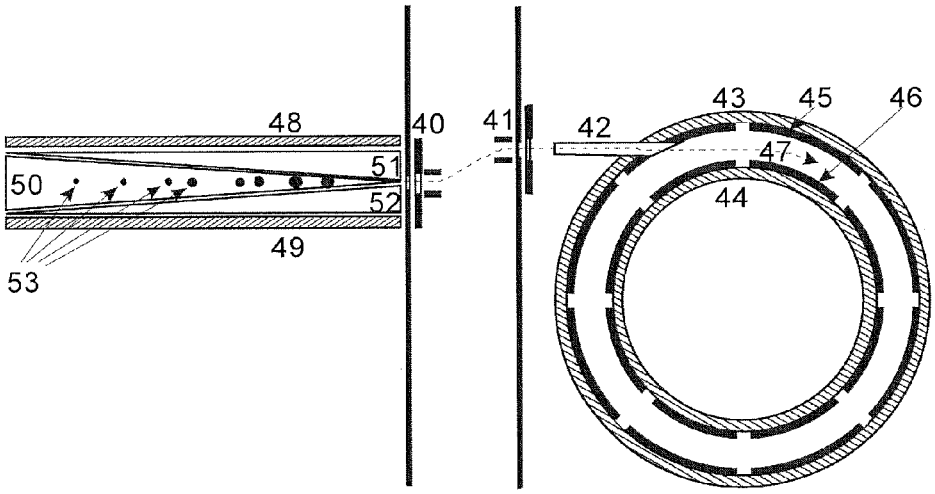

FIG. 12 illustrates the combination of the Kingdon ion trap with a particular linear RF ion trap. The RF quadrupole ion trap has a square cross-section and in this embodiment comprises four plates, two of which 48 and 49 are drawn here in cross section. The four plates are split into triangles, as can be seen on the back plate with the triangles 50, 51 and 52. Such a linear quadrupole ion trap can be supplied with two different types of RF voltage and two DC voltages in such a way that ions of different mass-to-charge ratio m/z collect at different locations, as is schematically indicated by the small clouds 53 (see German Patent DE 10 2010 013 546 to J. Franzen et al.). The small clouds 53 of ions of different mass-to-charge ratio can be ejected in such a way that the ions with the heaviest mass-to-charge ratio m/z emerge first. The small clouds can then be accelerated so that they all enter the Kingdon measuring cell simultaneously, or even so that the heaviest ions enter first and the lighter ions follow on.

Figure 13:
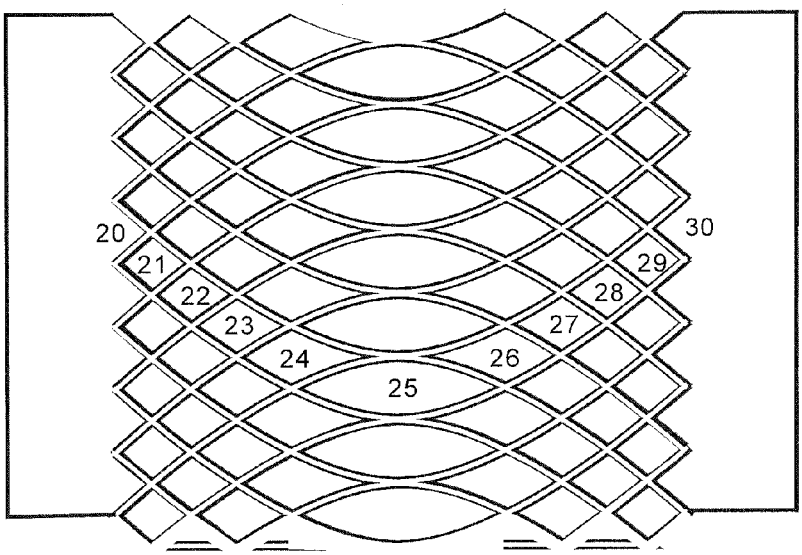

FIG. 13 depicts the unrolled electrode distribution of a cylinder with a larger number of groups of sheath electrode segments, which allows a more gentle gradation of the axial potentials. In this embodiment the groups, which each have eight sheath electrode segments of types 21 to 29, are between the two crown-shaped end electrodes 20 and 30. From the center plane toward the ends, it is possible to apply a total of six potentials $U_1$ to $U_6$, which all have the same potential difference ΔU, in order to generate the parabolic potential profile in the axial direction. The potentials may be generated from a single voltage by a single voltage divider. The voltage divider may contain devices for the fine adjustment of the voltages.

Figure 14:
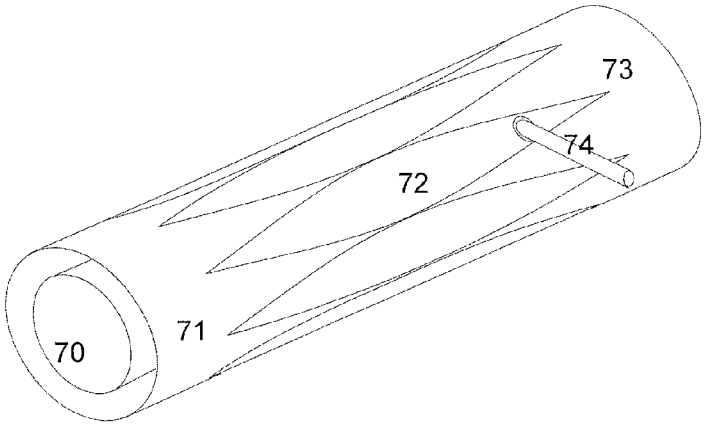

FIG. 14 illustrates a simplified version of the measuring cell according to an aspect of the invention, comprising two crown-like electrodes 71 and 73 at the ends, and eight double-angled electrodes 72 in the center. Ions are introduced through tube 74.

Figure 15:
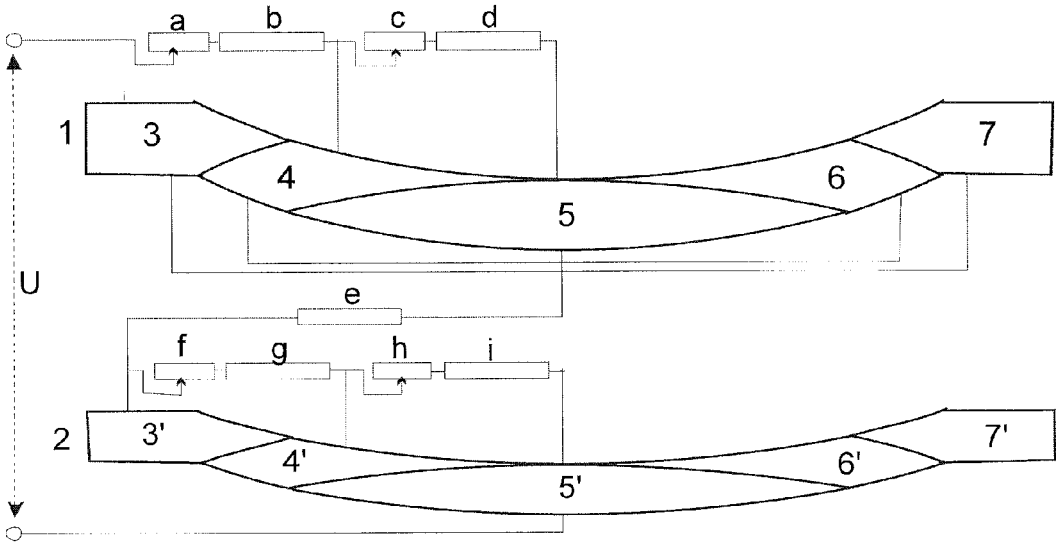

FIG. 15 illustrates a simplified voltage supply device for a measuring cell in accordance with FIG. 5, where only one electrode segment from each of the groups 3-7 of the outer cylindrical sheath 1 and 3' to 7' of the inner cylindrical sheath 2 is shown. The necessary potentials are generated by a single voltage divider with the resistors a-i, where adjustable resistors a, c, f and h are used for the fine adjustment of the potentials.

DETAILED DESCRIPTION OF THE INVENTION

A measuring device for measuring the oscillations of ions in a potential well contains an electrostatic measuring cell according to the Kingdon principle, which comprises shaped sheath electrode segments, insulated from each other by parabolic gaps, forming two concentric cylindrical surfaces. FIG. 5 illustrates such an arrangement. When appropriate voltages are applied to the sheath electrode segments, ions injected tangentially into the space between the two cylindrical surfaces can orbit around the inner cylinder on circular trajectories and harmonically oscillate in the axial direction, independently of their orbiting motion. The motion trajectories are shown schematically in FIG. 6; the trajectories must precisely lie on the sheath of a cylinder when the two motions are decoupled.

The measuring device according to an aspect of the invention comprises a voltage supply, which supplies the necessary voltages for the sheath electrode segments of the measuring cell, and a device for measuring the ion oscillations by measuring the image currents in selected sheath electrode segments.

The sheath electrode segments may preferably cover the complete area of the cylindrical surfaces, with only narrow separating gaps to insulate the sheath electrode segments from each other. The sheath electrode segments can be formed from metal sheets, for example, but can also be metal coatings on an insulating substrate. The separating gaps can be filled with insulating material, but can also be simply open.

The sheath electrode segments should not necessarily form cylindrical surfaces in order to create the desired ion trajectories. It is also possible for the sheath electrode segments to form two concentric surfaces of other rotational bodies. The potentials must then be adjusted to the sheath electrode segments in order to generate the desired field distribution in the space between the surfaces. The space in between must be able to be evacuated efficiently, for example by the surface of the outer rotational body opening out like a funnel toward the end. Cylindrical surfaces are, however, preferred because the surfaces can then be manufactured easily and with high precision. The descriptions below are presented in the context of the cylindrical arrangements for example, but without wishing to restrict the scope of the invention.

These novel measuring cells are completely open at their ends in these examples, and can therefore be evacuated efficiently. The voltages at the sheath electrode segments can be varied, and it is therefore possible to undertake corrections in order to completely decouple the transverse and axial motions even when the device is in operation; the useful duration of the image current transient, and therefore the resolution, can thus be optimized. For a commercial mass spectrometer, this fine adjustment of the potentials can be carried out once at the factory, for example.

Figure 6:
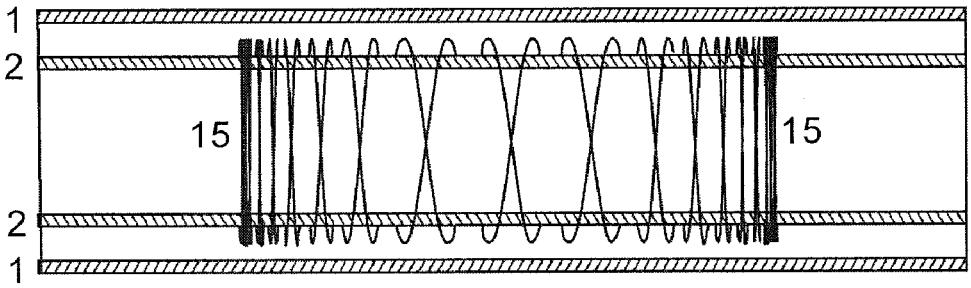
FIG. 6 illustrates the trajectories 15 of the ions as they are formed in the arrangement according to FIG. 5. Orbiting motions form around the inner cylinder 2 as well as harmonic longitudinal oscillations in the axial direction. One of the advantages of the Kingdon measuring cell according to aspects of the present invention over the Orbitrap™ are that it can be evacuated much more easily due to its open construction. In addition, the orbital motion can be completely decoupled from the axial motion by fine adjustment of the potentials. Furthermore, it is highly probable that the slight potential jumps which the ions experience on their trajectories lead to coherence focusing, as is the case in similarly formed ICR cells.

The sheath electrode segments of the two concentric cylindrical surfaces are shown in FIG. 5. The shapes of corresponding sheath electrode segments of the inner and outer cylinders are geometrically similar to each other and result from each other by radial projection. The sheath electrodes of the two cylinders of the measuring cell are generated by separating gaps which, as is shown in FIG. 7, have a parabolic shape when the cylinder is unrolled (developed) in a plane. The summits of the parabolas are in the center plane of the measuring cell; the tangents in the summits run parallel to the axis of the measuring cell. In these cases, two parabolas open in the opposite direction and meet at the summit. This forms the sheath electrode segments into a number of crown-like, tetragonal and double-angled shapes 3-7, which are separated and insulated from each other by the parabolic separating gaps. All the separating gaps should preferably have widths as identical as possible. When suitable voltages are applied to the sheath electrode segments, ions 9 injected tangentially through tube 8 can orbit around the inner cylinder on circular trajectories in the space between the two cylinders and the orbiting ions can execute harmonic oscillations in the axial direction, independently of this circular motion. The radius of the circular motion does not change here. Such a superposition of the ion motions 15 includes circular motion and axial oscillation as depicted in FIG. 6. The ion clouds of different ion masses and ionic charges oscillating harmonically in the axial direction induce image currents in suitably selected sheath electrode segments, from which the oscillation frequencies, and thus the mass-to-charge ratios m/z, of the ionic species can be determined by Fourier analyses.

According to an aspect of the present invention, FIG. 14 illustrates a simplified version of the measuring cell, comprising only two crown-like electrodes 71 and 73 at the ends, and comprising eight double-angled electrodes 72 in the center. Ions enter through the tube 74. Besides the potential difference $\Delta V$ between inner and outer electrodes, only one potential difference $\Delta U$ is needed to be supplied between the crown-like end electrodes and the inner double-angled, cigar-shaped electrodes. With this configuration, it is not possible to adjust the electric hyperlogarithmic field; the electrodes, therefore, have to be manufactured very precisely.

The arrangement of FIG. 5 includes 26 sheath electrode segments for each of the two cylinders. This number is not mandatory; it is contemplated there can be more or less sheath electrode segments. The minimum is four sheath electrode segments per cylinder, two double-angled electrodes of type 72 of FIG. 14, where these must extend around half of the cylinder, and two crown-like electrodes each of the types 71 and 73 of FIG. 14, which make up the remainder of the cylindrical sheath.

The power supply for the arrangement according to FIG. 5 is relatively simple despite the large number of sheath electrode segments of both cylindrical sheaths. Identical potentials are applied to the groups 3 to 7 of sheath electrode segments of the same type at both cylindrical sheaths. If a parabolic potential well is to be generated in the longitudinal direction, the potential U must be applied to the group of central sheath electrode segments 5 of the outer cylindrical sheath, the potential $(U+\Delta U)$ to both groups of sheath electrode segments 4 and 6, and the potential $(U+2\Delta U)$ to the crown-shaped end electrode segments 3 and 7. The same voltage difference $\Delta V$ must be applied everywhere between each of the corresponding sheath electrode segments of the inner and outer cylindrical sheaths in order to obtain the same radial electric field everywhere between the two cylindrical sheaths (apart from disturbances at the transitions between adjacent sheath electrode segments). All the potentials for the sheath electrode segments of the inner and outer cylindrical sheaths can be generated, in principle, from a single voltage U by a simple voltage divider, as shown in FIG. 15. The voltage divider of FIG. 15 also incorporates variable resistors a, c, f and h, which are used for the fine adjustment of the potentials in order to remove any coupling between the ion motions in the transverse and the axial direction. Such fine adjustment can be carried out at the factory, for example.

It is worth noting that the potential distribution between the two sheath surfaces for this type of measuring cell in accordance with FIG. 5 no longer has a hyper-logarithmic form, but is much more complicated. The gradient of the parabolic potential well in the axial direction in an arbitrary cross-section of the measuring cell is evident only as an average of the potential gradients on a circular trajectory around the inner cylinder in this cross-section.

The radial potential distribution in different cross-sections through this measuring cell according to FIG. 5 is shown in the two FIGS. 8 and 9. There are cross-sections without field disturbances (FIG. 8) and those with 16 small potential transitions (FIG. 9), although they only disturb the orbit of the fast ions very slightly, like trajectories in a weak alternating field at right angles to the direction of flight. In all probability, they will lead to coherence focusing of the cycling ion clouds, as was proven to exist in corresponding ICR measuring cells according to FIG. 2.

The potential well which is generated in the space between the cylinders by the above potentials at the sheath electrode segments at the mean value of the circular orbits can be seen in the bottom part of FIG. 7. In the section between locations A and E, the averaged potential well has a very good parabolic form; in this section the ions can optimally oscillate harmonically. It is therefore also ideal to inject the ions onto the circular trajectory at one of the locations A or E in order to make their axial oscillations start from here.

By the two potential differences ΔU and ΔV, the radius $r_a$ of the outer cylindrical sheath 1, the radius $r_i$ of the inner cylindrical sheath 2 and the length l of the two cylinders, one is free to select the depth of the potential well in the axial direction, and thus the frequency of oscillation of an ion in the axial direction, on the one hand, and the orbital frequency of this ion around the inner cylinder on the other. The computational methods necessary for this are familiar to any specialist skilled in the art. It is advantageous here to select the frequency of the circular motion many times higher, twenty times, for example, than the frequency of the axial oscillation, as can also be seen in FIG. 6. Thus the potential transitions on the orbits, which can be seen in FIG. 9, are also relatively small.

As is shown in FIG. 10, the ions of a highly accelerated ion beam 9 can be tangentially injected into the space between the cylindrical sheaths at an appropriate point outside the center plane of the measuring cell through the tube 8, which passes through the sheath electrode segment 10 and is insulated from it. Both the tube 8 and the sheath electrode segment 10 can be temporarily switched to potentials which deviate from that of the sheath electrode segments 6 of the same group in order for the ions to reach the tangent to the orbit in the center between the cylindrical sheaths through a slightly weakened radial field. It is particularly advantageous if the ions of the ion beam 9 arrive bundled into short clouds. It is furthermore particularly advantageous if the heavy ions arrive slightly earlier than the light ions, whose orbital velocity is much higher than that of the heavier ions. Before the lightest ions on their orbit reach the sheath electrode segment 10 again, its potential and the potential of the tube 8 has to be switched back to the potential of the sheath electrode segments 6 in order not to disturb the subsequent orbiting of the ions. With an advantageous embodiment of the injection electrodes it is possible to only switch the potential of the tube 8 in order to bring the ions onto the desired orbit.

The ions can be injected without the axial potential well being switched on beforehand. They then initially orbit around the inner cylinder at the location where they were injected. It is then essential to switch the potential of the sheath electrode segment 10 and the tube 8 back to normal potential, before one orbit of the injected ions is completed. If the injected ions have a slight diffuseness in their kinetic energy, ions of the same species disperse across the complete trajectory after a few orbits, and they occupy orbits with slightly different radii. If the potential well is then switched on, the orbiting ions start the axial oscillation, and the measurement of the image currents can begin.

The ions may be injected with the potential well already switched on. The ions then begin the axial oscillation immediately after they have been injected. If the injection can be effected solely by switching the potential of the narrow tube 8, the injection can even extend over the period that elapses until the fastest ions return from their axial oscillation and arrive back at the place where they were injected. Only then must the potential of the tube 8 be switched back to normal potential.

In the measuring cell illustrated FIG. 5, the two groups of tetragonal sheath electrode segments of types 4 and 6 are particularly good as image current detectors because the oscillating ions here spend a particularly long time at their points of reversal. All the sheath electrode segments of group 4 are combined, as are all the sheath electrode segments of group 6, and each group is connected to one of the differential inputs of the image current amplifier. In order to reduce electronic disturbances to the extremely sensitive image current amplifier, it is often expedient to bring the sheath electrode segments of groups 4 and 6 precisely to ground potential for this purpose, via the image current amplifier, and to adjust the potentials of all the other groups of sheath electrode segments correspondingly.

It is also possible to measure the image currents at the double-angled cigar-shaped central sheath electrode segments of group 5, however. The ions fly past these sheath electrode segments twice during one period of oscillation, i.e., double the frequency is measured here, which is advantageous because the image current transient has twice the resolution for the same measuring time.

The image currents can be measured at the sheath electrode segments of the inner or outer cylindrical sheath. Since the image current amplifier is advantageously operated at ground potential, the choice depends on which other instruments this measuring cell is to be coupled with, and at which potential the ions are created, because the ions must be injected into the measuring cell with considerable energy of a several kilovolts (preferably between four and six kilovolts). It is also possible to measure the image currents using electrodes of both cylindrical sheaths, although two image current amplifiers must be used, at least one of which has to be operated at a high potential.

It is also possible to inject the ions in the center plane of the measuring cell, instead of outside the center plane at the point of reversal of the axial ion motions. If the ions are injected in the center plane, they have to subsequently be excited to axial oscillations, for example by a "chirp" at the terminal crown electrodes. This mode of operation is therefore less straightforward than an injection outside the center plane, but can be used in special cases.

The measuring cell of FIG. 5 shows only five groups 3 to 7 of sheath electrode segments per cylindrical sheath, to which only three potentials are applied. If the voltage ΔV between corresponding electrodes of the outer and inner cylindrical sheaths is five kilovolts, for example, and if the depth of the useful portion of the potential well is to amount to around 1.5 kilovolts, then the voltage difference ΔU must also be around 1.5 kilovolts, as can be seen from FIG. 7. This, however, results in potential jumps of considerable magnitude between adjacent sheath electrode segments, which occur along the orbit around the inner cylinder. In order to keep these potential jumps smaller, the number of groups of sheath electrode segments can be increased, namely by the parabolic separating gaps intersecting several times toward the outside and producing further groups of tetragonal sheath electrode segments. FIG. 13 shows an unrolling pattern of one of the cylindrical sheaths of a measuring cell, where a total of six potentials with five voltage differences ΔU are applied to eleven groups 20 to 30 of sheath electrode segments. These potentials can also be generated easily with only a single voltage divider. But it is now possible to use a smaller voltage difference of only ΔU=0.5 kilovolts for the same useful depth of the potential well.

A simple, particularly favorable method for measuring mass spectra in a cylindrical measuring cell according to one of the arrangements shown in FIG. 14 or 5 can be described by the following steps: a) provide a measuring cell with sheath electrode segments which form two concentric cylindrical sheaths, the sheath electrode segments separated by parabolic gaps, b) apply appropriate potentials to the sheath electrode segments, c) inject suitably accelerated ions onto an orbit around the inner cylinder; the injection is preferably done outside the center plane, d) measure the image currents at selected sheath electrode segments, and e) calculate the mass spectrum from the image current transient.

Those skilled in the art can easily expand the Kingdon measuring cells according to the aspects of the present invention to create a complete mass spectrometer by adding an ion source, vacuum pumps, electric and electronic supply units and further devices.

A special use of such a Kingdon measuring cell includes a combination with a three-dimensional Paul ion trap, as is shown in FIG. 11. The ions are injected from the outside through the RF ion guide 31 and the ion lens 32 into the Paul ion trap with two end cap electrodes 33 and 35 and one ring electrode 34, and are collisionally focused there by a collision gas at a pressure of between around 0.1 and 1 pascal to form a small cloud 36. The three-dimensional Paul RF ion trap itself can be used as a mass spectrometer by ejecting ions of the ion cloud 36 mass-sequentially, converting them into electrons at the conversion dynode 38, and measuring them as a mass spectrum in the secondary electron multiplier 39. An advantage is that the ions in the ion trap can be manipulated in a variety of ways for further investigations. It is possible, for example, to isolate parent ions in the ion trap and fragment them in several different ways to form daughter ions. The different fragmentation methods result in different types of information on the ions. If the daughter ions are then to be measured with very high mass resolution and very high mass accuracy, they must be transferred into a mass spectrometer which provides this high mass resolution and mass accuracy.

In FIG. 11, a Kingdon measuring cell according to an aspect of this invention serves as the basis for this high-resolution mass spectrometer. The ion cloud 36 is ejected from the ion trap by a voltage pulse at one of the end cap electrodes, and accelerated, laterally deflected and focused by the acceleration and deflection elements 37, 40 and 41 along the trajectory 47 in such a way that the ions enter through the tube 42 tangentially into the Kingdon measuring cell and reach the orbit. The double lateral deflection of the ion beam 47 to produce an offset of the ion beam serves to prevent any gas jet from the Paul ion trap from streaming directly into the Kingdon measuring cell. Bunching processes can be used to manipulate the ions on their flight path in special acceleration and travel regions in such a way that the heavy ions enter the Kingdon measuring cell first despite their slower flight motion, the heavy ions having the same kinetic energy as the light ions. These special bunching regions are not shown in FIG. 11, but are known in the art (e.g., see German Patent DE 10 2007 021 701 A1 to O. Räther et al.).

The electrodes 45, 46 of the outer and inner cylindrical sheath of the Kingdon ion trap can be kept in their position by insulator tubes 43, 44 made of Macor, for example. The resolution increases in proportion to the number of the oscillations which can be measured as an image current transient. The orbiting ions cover a distance in the order of around ten kilometers every second; in order for as many of the ions as possible to be able to fly undisturbed over many seconds, the mean free path must amount to hundreds or even thousands of kilometers. A vacuum of $10^{-8}$ pascal or better, if possible, must be generated in the Kingdon measuring cell. It is therefore necessary to introduce several vacuum steps with differential pump chambers between the Paul ion trap (e.g., around 1 pascal) and the Kingdon ion trap (e.g., $10^{-8}$ pascal); these are merely implied in FIG. 11. The lateral offset of the ion trajectory 47 also serves to improve the pressure gradation because it prevents a gas jet from shooting directly from the Paul trap into the Kingdon trap.

The Kingdon ion trap may also be combined with other devices. FIG. 12, for example, shows the combination of the Kingdon ion trap with a special linear RF quadrupole ion trap. This special ion trap has a square cross-section; it includes four plates and generates a quadrupole field in the interior. All four plates are split into triangles, however, as can be seen on the plate at the back with the triangles 50, 51 and 52. Such a linear quadrupole ion trap can be supplied with two different types of RF voltage and two superimposed DC voltages in such a way that two axial potential profiles form in the interior: an axial DC voltage profile and an axial pseudopotential profile, which has the opposite direction to the DC voltage profile. Since a DC field exerts a force proportional to the charge z, whereas a pseudopotential exerts a force proportional to z/m, ions of different mass-to-charge ratio m/z collect at different locations, as is schematically indicated by the small clouds 53. German Patent DE 10 2010 013 546 to J. Franzen et al. describes RF ion traps with superimposed DC voltage and pseudopotential gradients along the axis. The small clouds 53 with the ions of different mass-to-charge ratio can be ejected by changes to the voltages in such a way that the ions with the heaviest mass-to-charge ratios m/z emerge first. The exiting clouds can then be accelerated so that they all enter the Kingdon measuring cell simultaneously, or even so that the heaviest ions enter first and the lighter ions follow on.

The special linear ion trap according to FIG. 12 can also be used as an intermediate stage between a Paul ion trap according to FIG. 11 and the Kingdon measuring cell. The bunching regions can then be omitted.

An advantage of Kingdon ion trap mass spectrometers over ion cyclotron resonance mass spectrometers (ICR-MS) with similarly high mass resolutions R is that no homogeneous magnetic field of high field strength, which is difficult to generate, is required to store the ions, and thus the instrumental set-up is much less complex. In a Kingdon measuring cell, the ions are stored in a DC field and thus only DC voltages are required at the electrodes, although these DC voltages must be kept constant with a very high degree of precision. Moreover, the decrease in resolution R in Kingdon ion trap mass spectrometers is only inversely proportional to the square root $\sqrt{(m/z)}$ of the mass-to-charge ratio m/z of the ions, whereas in ICR-MS the decrease in resolution R is inversely proportional to the charge-related mass m/z itself; this means the resolution falls off much more rapidly toward higher masses in ICR-MS in an unfavorable way.

The Kingdon measuring cells described here are therefore electrostatic measuring cells, which are usually operated without any magnetic field. It should, however, be noted here that these measuring cells can also be operated in magnetic fields, for example in a not overly strong, axially oriented magnetic field of a permanent magnet. However, it is then necessary to inject the small clouds of different mass-to-charge ratios m/z into the measuring cell with different kinetic energies in order for them all to orbit on circular trajectories of roughly the same size. Such an arrangement may have a positive effect in terms of conserving the coherence of the individual small clouds of ions.

With knowledge of this invention, those skilled in the art will be able to develop further advantageous embodiments for Kingdon measuring cells and corresponding acquisition methods for mass spectra; these shall also be covered by this protection claim.

Although the present invention has been illustrated and described with respect to several preferred embodiments thereof, various changes, omissions and additions to the form and detail thereof, may be made therein, without departing from the spirit and scope of the invention.

What is claimed is:

1. A device for determining the mass-to-charge ratios m/z of ions by measuring their oscillations in a potential well, comprising:

a measuring cell, that includes sheath electrode segments insulated by parabolic gaps with respect to each other, together foaming the surfaces of two concentric cylindrical sheaths;

a voltage generator, that supplies the sheath electrode segments with potentials so that the ions in the measuring cell both orbit around the inner cylindrical sheath surface and oscillate in the axial direction in the space between the two cylindrical sheath surfaces; and a measuring device that measures the oscillating motion of the ions in the axial direction.

2. The device according to claim 1, wherein the potentials at the sheath electrode segments of the measuring cell are adjustable to make the motion of the ions in the axial direction independent of their transverse motion.

3. The device according to claim 1, wherein, in the measuring cell, the sheath electrode segments of the inner and outer cylindrical sheath surfaces, which oppose each other across the intermediate space, are geometrically similar to each other.

4. The device according to claim 1, wherein the summits of the separating gap parabolas are in a center plane, perpendicular to the axis of the measuring cell; the tangents to the summits are aligned parallel to the axis of the measuring cell; the orientations of the openings of the gap parabolas alternate around the circumference; and the summits of two adjacent gap parabolas around the circumference touch each other, resulting in groups of sheath electrode segments with the same shape.

5. The device according to claim 4, wherein the voltage generator supplies identical voltage differences $\Delta U$ between adjacent groups of the same sheath electrode segments.

6. The device according to claim 1, wherein the voltage generator supplies identical voltage differences $\Delta V$ between corresponding sheath electrode segments of the inner and outer cylindrical sheaths in each case.

7. The device according to claim 1, comprising a device for the tangential injection of the ions into the space between the two cylinders.

8. The device according to claim 1, coupled to a linear or a three-dimensional ion trap so that ions from the linear or three-dimensional ion trap can be transferred into the measuring cell.

9. The device according to claim 1, wherein the measuring device that measures the oscillating motions of the ions measures the ion-influenced image currents at selected sheath electrode segments of the measuring cell.

10. A method for measuring mass spectra in an electrostatic measuring cell, comprising:

providing a measuring cell with sheath electrode segments separated by parabolic gaps together forming two concentric cylindrical sheaths;

applying appropriate potentials to the sheath electrode segments;

injecting suitably accelerated ions onto an orbit around the inner cylindrical sheath;

measuring the image currents at selected sheath electrode segments; and calculating the mass spectrum from the image current transient.

11. The method according to claim 10, wherein the step of injections is preferably done outside a center plane.

12. The method according to claim 10, wherein coherent clouds of ions with large and small mass-to-charge ratios are injected simultaneously, or wherein the coherent clouds of the heavy ions are injected into the measuring cell before those of the light ions.

13. The method according to claim 12, wherein the coherent ion clouds are injected into the measuring cell from a linear or three-dimensional ion trap.

14. The method according claim 10, wherein the measuring cell is operated in a magnetic field.

15. A device for determining the mass-to-charge ratios in/z of ions by measuring their oscillations in a potential well, comprising:

a measuring cell with a plurality of sheath electrode segments insulated with respect to each other by parabolic gaps, which form two concentric sheath surfaces of rotational bodies;

a voltage supply, which supplies the sheath electrode segments with potentials so that the ions in the measuring cell both orbit around the inner sheath surface and oscillate in the axial direction in the space between the two sheath surfaces; and a measuring device for measuring the oscillating motion of the ions in the axial direction.

* * * * *

UNITED STATES PATENT AND TRADEMARK OFFICE

CERTIFICATE OF CORRECTION

PATENT NO. : 8,319,180 B2
APPLICATION NO. : 13/208803
DATED : November 27, 2012
INVENTOR(S) : Evegij Nikolaev and Jochen Franzen It is certified that error appears in the above-identified patent and that said Letters Patent is hereby corrected as shown below:

Column 15
Line 15, please delete “foaming” and insert --forming--.

Column 16
Line 35, please delete “in” and insert --m--.

Signed and Sealed this
Twelfth Day of February, 2013

Teresa Stanek Rea
*Acting Director of the United States Patent and Trademark Office*